US005216990A

United States Patent [19]

Moosmann et al.

[11] Patent Number: 5,216,990

[45] Date of Patent: Jun. 8, 1993

[54] GLOW PLUG FOR INTERNAL COMBUSTION DIESEL ENGINE

[75] Inventors: Rolf Moosmann, CH-1164 Buchillou; Diethard Wenzel, Waldshet, both of Switzerland

[73] Assignee: Rolf Moosmann, Switzerland

[21] Appl. No.: 923,719

[22] Filed: Jul. 31, 1992

[30] Foreign Application Priority Data

Aug. 2, 1991 [CH] Switzerland ..... 02301/91

[51] Int. Cl.[5] ..... F02M 31/16; F23Q 7/00

[52] U.S. Cl. ..... 123/145 A; 123/179.21; 431/208

[58] Field of Search ..... 123/145 A, 179.21; 219/205, 206, 207; 431/208, 263

[56] References Cited

U.S. PATENT DOCUMENTS 1,359,514 11/1920 Lightfoot ..... 123/145 A
1,632,314 6/1927 Rudqvist ..... 123/145 A
3,602,206 8/1971 Hase et al. ..... 123/550
4,703,740 11/1987 Trapy ..... 123/531
4,751,900 6/1988 Ruffolo ..... 123/190.6

FOREIGN PATENT DOCUMENTS 3602136 7/1987 Fed. Rep. of Germany .
3825013 1/1990 Fed. Rep. of Germany .
2151865 4/1973 France .
290733 11/1931 Italy ..... 123/145 A

*Primary Examiner*—Tony M. Argenbright
*Attorney, Agent, or Firm*—Davis, Bujold & Streck

[57] ABSTRACT

The glow plug comprises a main body (10) inside which there is attached a heating unit (13), a vaporizing chamber (18) and a mixing chamber (32) for mixing flowing air (A) with vaporized fuel supplied via a conduit (19) through a filter (20) and a calibrated conduit (21). A socket (30) is attached to the end of the main body (10), said socket being traversed by a transverse pipe (31) preferably in the shape of a Venturi tube with the narrowed central portion forming the mixing chamber (32) and being located at the level of an end portion of the heating unit (13).

10 Claims, 3 Drawing Sheets

GLOW PLUG FOR INTERNAL COMBUSTION DIESEL ENGINE

The present invention concerns a glow plug for an internal combustion diesel engine consisting of a main body with at least one heating unit, a calibrated opening to admit fuel, an evaporation chamber at least partially surrounding the heating unit and a mixing chamber for mixing flowing air with vaporized fuel, said mixing chamber at least partially surrounding said heating unit and located in the extension of said vaporizing chamber.

This type of glow plug is presently used in diesel engines, particularly in vehicle engines, construction equipment, boats, etc. and is more particularly described in German Patent Application No. DE 36 02 136 A1 published prior to examination. These glow plugs have a generally cylindrical body inside which the heating unit is attached, partially surrounded by a cylindrical wall which, together with the heating unit, forms an area called the evaporation chamber. At the base or the free end of this glow plug there is a generally cylindrical tube partially surrounding the end of the heating unit and prolonging the vaporizing chamber. This tube is perforated and located in an air flow pipe, causing the vaporized fuel to be sucked into the vaporizing chamber and the vaporized fuel to mix with the flowing air. This mixture, having taken place in the mixing chamber defined by the generally cylindrical tube, is then heated by the red hot heating unit, thereby generating a flame with its base inside the mixing chamber and extending in the direction of said air flow.

The perforated tube defining the mixing chamber which is currently in use has several disadvantages. For one, there is a considerable carbon deposit at the level of the heating unit, which severely limits the life of the glow plug; furthermore, the flame base is relatively unsteady because it is at the level of several small openings in the tube wall and at the level of the open base of the tube. Finally, the speed at which this tube admits air rarely exceeds 20 m/s, a major handicap, as the glow plug is extinguished whenever the air flow surpasses this speed, that is, whenever the motor accelerates. The present tendency is to keep this flame lit for some time after the motor has started up or during certain critical phases of motor function to eliminate or reduce pollution caused by uncombusted hydrocarbons, generally manifested as a cloud of smoke from the exhaust pipes.

The present invention proposes overcoming all these disadvantages by achieving a glow plug guaranteeing improved flame quality and improved flame stability, even at substantially higher air flow speeds than are presently possible for such glow plugs.

To achieve this, the glow plug according to the invention is characterized in that said mixing chamber is defined by a pipe open at both ends, the axis of which corresponds at least approximately to the direction of air flow, said pipe being transversely disposed in relation to the heating unit and having a narrow central portion within which the free end of said heating unit is located.

According to a first embodiment, said pipe comprises an air flow inlet opening, one portion of which has one surface higher than the portion of an outlet opening for the air-vaporized fuel mixture.

According to another embodiment, said pipe comprises an air flow inlet opening, one portion of which has one surface which is lower than the portion of an outlet opening for the air-vaporized fuel mixture.

In a particularly advantageous variation, the mixing chamber and said pipe are housed in a socket attached to one end of the main body in the extension of the vaporizing chamber.

In the case of this embodiment, the socket is essentially cylindrical in shape.

The axis of the pipe passing therethrough may be generally perpendicular to the axis of the socket.

According to a variation, the axis of the transverse pipe may form an acute angle with the axis of the socket.

According to another embodiment, the glow plug may comprise several generally parallel transverse pipes oriented toward the axis of the air flow.

According to another embodiment, the glow plug may comprise several heating units, with at least one of their end portions being located within said mixing chamber.

According to a variation which may be used in certain cases, the pipe may comprise at least one opening, the axis of which is generally parallel to the glow plug axis.

The present invention will be more readily understood with reference to the description of some exemplary embodiments and to the attached drawing, in which.

Figure 1B:
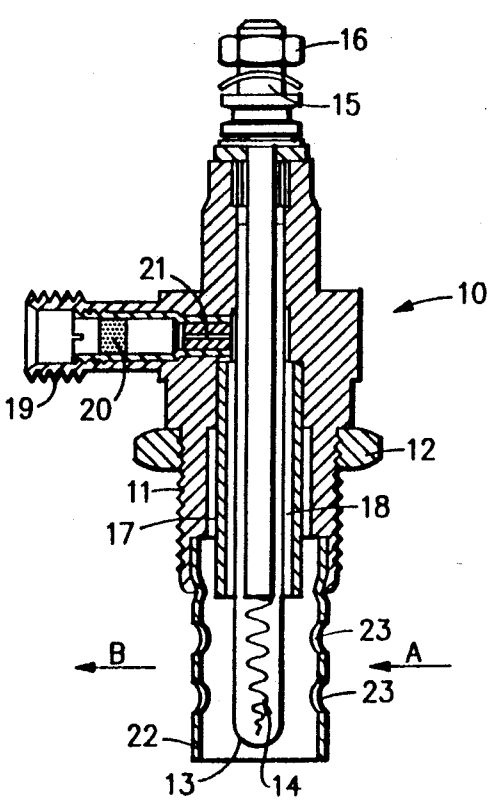
FIGS. 1A and 1B show a prior art glow plug.
Figure 1A:
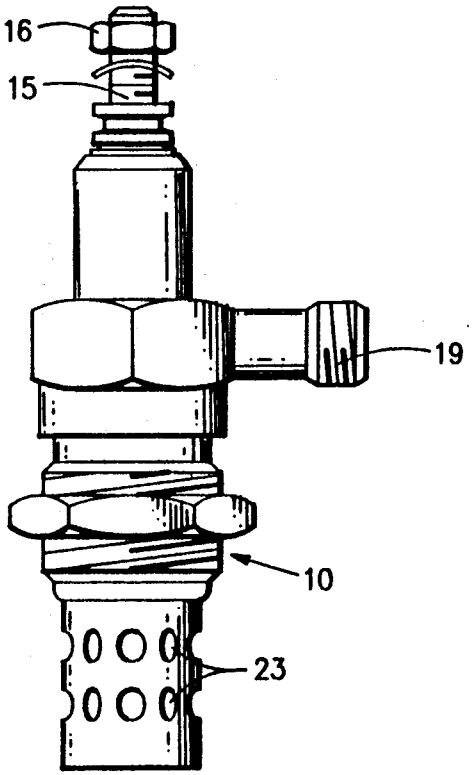

With reference to FIGS. 1A and 1B, the prior art glow plug and shown in elevation by FIG. 1A and in axial cross-section by FIG. 1B, respectively, comprises a main body 10 with a threaded lower end portion 11 so it can be attached with screw 12 onto a diesel engine block. Main body 10 is hollow and contains a heating unit 13 which contains, in a manner known in the art and more specifically described by German Patent Application No. 38 25 013 A1 published prior to examination, one or more heating resistors 14. The heating unit terminates at the upper end of the glow plug in a terminal 15 into which a tightening screw 16 is screwed.

Inside main body 10 there is a tubular element 17 coaxial to heating unit 13, which defines a vaporizing chamber 18 corresponding to the space formed between heating unit 13 and tubular element 17.

The main body is also equipped with a conduit 19 for passage of combustible fluid into vaporizing chamber 18 through a filter 20 and a calibrated opening 21.

At the lower extremity the glow plug has a cylindrical coupler 22 prolonging main body 10 of the glow plug and surrounding the end portion of heating unit 13. The coupler is cylindrical and open at both ends so that its upper portion communicates with the vaporizing chamber 18 and the mixture of air and vaporized fuel can escape through the bottom. This cylindrical coupler has a series of lateral openings, for example a double row of circular openings 23 designed to admit a portion of the air flow shown by arrow A and to permit the escape of the air-vaporized fuel mixture heated by the red hot heating unit shown by arrow B.

As mentioned above, this embodiment has a certain number of disadvantages and is conducive to carbon buildup on the heating unit, thereby shortening the life span of the glow plug considerably.

The various glow plug embodiments according to the invention differ from those of the prior art in that they eliminate cylindrical coupler 22 and replace it with a socket closed at one end and bored from end to end to define a transverse pipe traversing a mixing chamber where the air-vaporized fuel is mixed.

Figure 2:
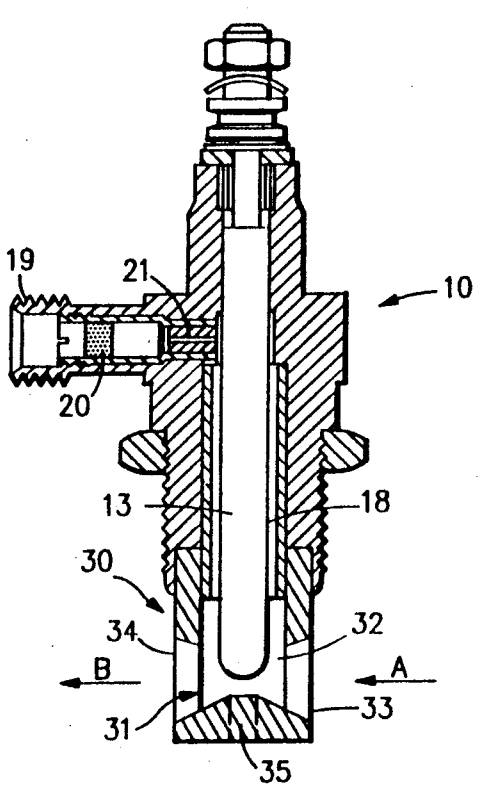
FIG. 2 is an axial cross-section of a first embodiment of a glow plug according to the invention.

In the embodiment shown in FIG. 2 transverse pipe 31 has a narrowed central portion and the lower end of heating unit 13 is situated approximately in its center. This forms a Venturi tube shape defined by a truncated orifice 33 which serves as an inlet for air flow A and a truncated orifice 34 which serves as an evacuation outlet for the air-vaporized fuel mixture B. In this embodiment the sections of openings 33 and 34 are essentially identical. The axis of pipe 31 is approximately perpendicular to the axis of heating unit 13. Socket 30 consists of a corresponding piece engaging in an appropriate annular opening formed at the end of main body 10 of the glow plug. The other components of this glow plug are identical or similar to those described previously with reference to FIGS. 1 and 2. In a certain design, the pipe may have one or more openings with axes essentially parallel to the glow plug axis. Such an opening 35 is shown by dashes. It is not obligatory, but has advantages for certain uses.

Figure 3:
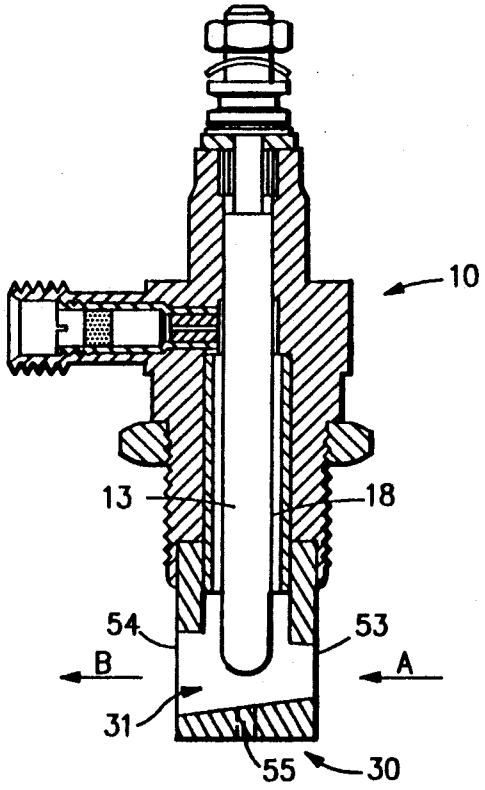
FIG. 3 is an axial cross-section of another embodiment of a glow plug according to the invention.

FIG. 3 shows an embodiment in which socket 30 is provided with a transverse pipe 31 having lateral walls which diverge in the direction of air flow indicated by arrow A and defining an inlet orifice 43 which is smaller than outlet orifice 44. In this embodiment, exiting flow B, that is, the air-vaporized fuel mixture, slows down while passing through pipe 31, which can be an advantage in certain engines. One particular design may include an opening 55 with the same functions as opening 35.

Figure 4:
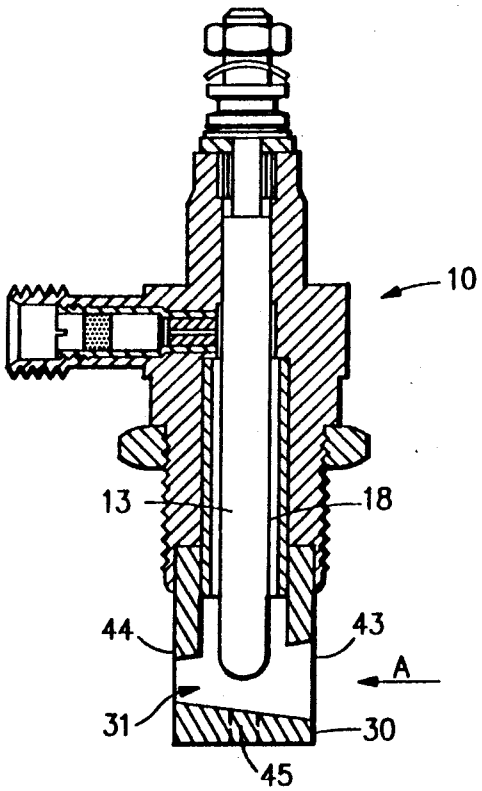
FIG. 4 is an axial cross-section of a variation of the embodiment shown in FIG. 3.

The embodiment shown in FIG. 4 differs from the preceding embodiment in that the lateral walls of transverse pipe 31 housed in socket 30 converge and define an inlet opening 53 which is larger in section than outlet opening 54. This embodiment causes the exiting air flow to accelerate in relation to the incident air flow defined by arrow A. This characteristic is specifically adapted to certain engines and helps to prevent carbon deposits on the heating unit, thereby extending the life of the glow plug. As before, it is possible to provide one or more openings 45 identical to openings 35 and 55.

Figure 5:
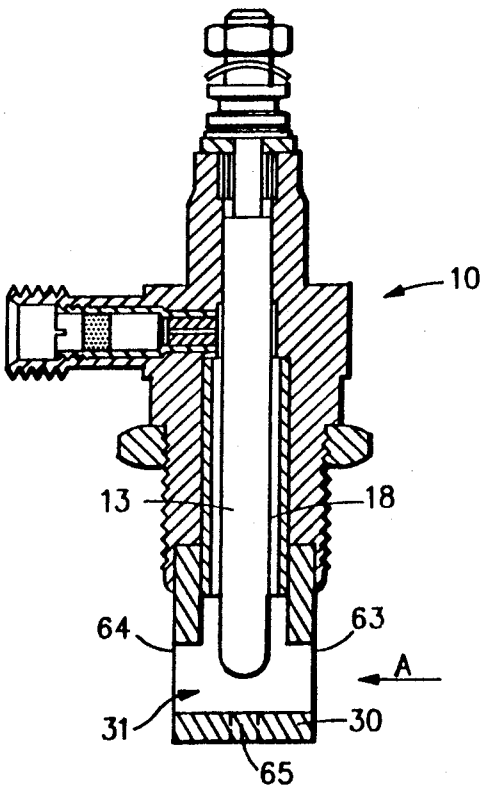
FIG. 5 is an axial cross-section of another embodiment of the glow plug according to the invention.

FIG. 5 shows another embodiment of socket 30 in which pipe 31 has cylindrical walls. In other words the transverse section of this pipe is essentially constant at the end portions, and inlet openings 63 and outlet openings 64 are identical in section. Note that the end of the heating unit is located generally at the level of the axis of pipe 31. One or more openings 65 may be provided.

Figure 6:
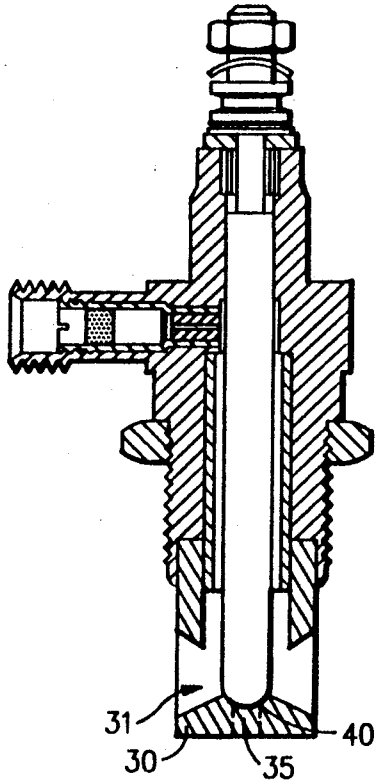
FIG. 6 is an axial cross-section of a variation of the glow plug illustrated in FIG. 2.

FIG. 6 shows a variation of the glow plug shown in FIG. 2. In the example shown, the heating unit extends beyond the axis of transverse pipe 31 housed in socket 30 and terminates in an opening 40 provided in the base of socket 30. Because of this, the mixing chamber is completely traversed by the end portion of the heating unit. One or more openings 35 may be provided, as in the example shown in FIG. 2.

Figure 7:
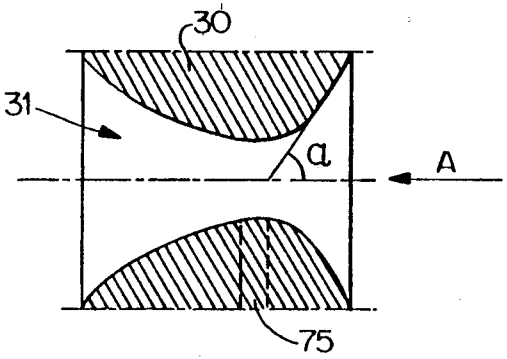
FIG. 7 is a schematic drawing of a particular shape of transverse pipe in the socket of the glow plug according to the invention.

FIG. 7 is a schematic illustration of a particular shape of the lateral walls of transverse pipe 31 in socket 30. The opening turned toward air flow A has walls which form an angle $\alpha$ of from 15° to 75° with the axis of pipe 31 and preferably about 60°. These walls then curve inwardly in relation to this axis and the angle they form with respect to the axis passes progressively from 0° to 45° or even 90°. The pipe may have one or more openings 75.

Generally speaking, the shape of the walls of pipe 31 may be infinitely modified according to the results desired. In most cases the pipe advantageously has a narrowed portion at the level of the heating unit, thereby allowing the air flow to accelerate at this place, which contributes to preventing carbon deposits on this component.

Figure 8:
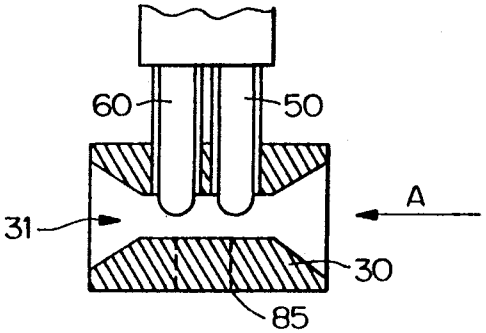
FIG. 8 is a schematic drawing showing a certain arrangement of the components of the glow plug according to the invention.

FIG. 8 is a schematic illustration of one embodiment wherein the glow plug comprises two heating units disposed in parallel, one after the other, in pipe 31 transversely disposed within socket 30. As before, the pipe may have one or more openings 85.

Figure 9:
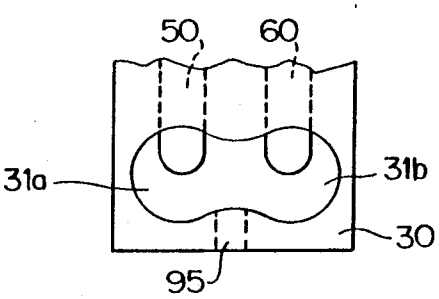
FIG. 9 shows another arrangement of the components of the glow plug of FIG. 8.

FIG. 9 is a schematic illustration of a glow plug wherein two heating units 50 and 60 are arranged in parallel inside two transverse pipes 31A and 31B, respectively, which are connected at their central portions to define the mixing chamber. For certain purposes, the pipe may have one or more openings 95.

The present invention is not limited to the embodiments described above, but may undergo various modifications and variations obvious to one skilled in the art. In particular, the form and shape of the walls of the transverse pipe may be modified and the axis of this pipe, rather than being perpendicular to the axis of the socket, may form an acute angle therewith. The same is true for the number of transverse pipes, as well as the number of heating units whose end portions are located inside the one or more transverse pipes. These different embodiments adapt to different engines and all have the goal of improving flame quality and stability, as well as maintaining the heating unit free of carbon, thereby extending the life of the glow plug.

We claim:

1. Glow plug for internal combustion diesel engine, comprising a main body with at least one heating unit, a calibrated opening to admit fuel, an evaporation chamber at least partially surrounding the heating unit and a mixing chamber to mix flowing air with vaporized fuel, said mixing chamber being disposed at least partially around said heating unit and in the extension of said vaporizing chamber, characterized in that said mixing chamber (32) is defined by a pipe (31) open at both ends and whose axis corresponds at least approximately to the direction of air flow (A), said pipe being disposed transversely in relation to the heating unit (13) and having a narrowed central portion in which the free end of said heating unit (13) is located.

2. Glow plug according to claim 1 characterized in that said pipe (31) comprises an air flow inlet opening (43), one portion of which has one surface which is lower than the portion of an outlet opening (44) for the air-vaporized fuel mixture.

3. Glow plug according to claim 1, characterized in that said pipe has an air flow inlet opening (53), one portion of which has one surface which is higher than the portion of an outlet opening (54) for the air-vaporized fuel mixture.

4. Glow plug according to claim 1 characterized in that the mixing chamber (32) and said pipe (31) are housed in a socket (30) attached to one end of the main body (10) in the extension of the vaporizing chamber (18).

5. Glow plug according to claim 4 characterized in that said socket (30) is essentially cylindrical in shape.

6. Glow plug according to claim 4 characterized in that the axis of the transverse pipe (31) is essentially perpendicular to the axis of the socket (30).

7. Glow plug according to claim 4 characterized in that the axis of the transverse pipe (31) forms an acute angle with the axis of the socket (30).

8. Glow plug according to claim 1 characterized in that it comprises several essentially parallel transverse pipes (31*a*, 31*b*) oriented toward the axis of the air flow.

9. Glow plug according to claim 1 characterized in that it comprises several heating units (50, 60), with at least one part of their end portions being located in said mixing chamber.

10. Glow plug according to claim 1 characterized in that said pipe (31) has at least one opening, the axis of which is parallel to the glow plug axis.

* * * * *